US007527396B2

(12) United States Patent
Weyhrauch et al.

(10) Patent No.: US 7,527,396 B2
(45) Date of Patent: May 5, 2009

(54) ILLUMINATION DEVICE WITH THERMALLY ISOLATED INTEGRAL POWER SUPPLY

(75) Inventors: Ernest C. Weyhrauch, Cookeville, TN (US); Matthew B. Ballenger, Lexington, KY (US); George B. Kendrick, Lexington, KY (US); John M. Cooper, Paris, KY (US)

(73) Assignee: Osram Sylvania Inc., Danvers, MA (US)

( * ) Notice: Subject to any disclaimer, the term of this patent is extended or adjusted under 35 U.S.C. 154(b) by 673 days.

(21) Appl. No.: 11/157,346

(22) Filed: Jun. 21, 2005

(65) Prior Publication Data

US 2005/0212393 A1 Sep. 29, 2005

(51) Int. Cl.
*F21V 29/00* (2006.01)
*F21V 7/20* (2006.01)
*H01J 1/02* (2006.01)

(52) U.S. Cl. ..... 362/294; 362/345; 362/373; 313/17

(58) Field of Classification Search ..... 313/17; 362/294, 345, 373
See application file for complete search history.

(56) References Cited

U.S. PATENT DOCUMENTS 6,445,133 B1 * 9/2002 Lin et al. ..... 315/57
2005/0111234 A1 * 5/2005 Martin et al. ..... 362/555

* cited by examiner

*Primary Examiner*—Nimeshkumar D. Patel
*Assistant Examiner*—Anne M Hines
(74) *Attorney, Agent, or Firm*—William E. Meyer

(57) ABSTRACT

An incandescent lamp may be formed from a shell having an exterior side and an interior side defining a cavity, and with an internal wall defining a through passage extending from the exterior side to the interior side. A light source is located in the cavity facing the interior side, and coupled to electric lamp leads extending through the passage. A heat radiator assembly is adjacent the exterior side, and includes heat-dissipating surfaces exposed to air. An integral power supply is enclosed in the heat radiator assembly and electrically connected to the light source through the electric lamp leads. A threaded base having exterior electrical contact points is electrically connected through base leads to the integral power supply. The shell, radiator assembly and base are mechanically coupled as a unit. A lens may cover the shell to enclose the cavity and light source.

5 Claims, 3 Drawing Sheets

ILLUMINATION DEVICE WITH THERMALLY ISOLATED INTEGRAL POWER SUPPLY

BACKGROUND OF THE INVENTION

Incandescent lamps are known to operate with better performance at lower voltages. Including a line voltage reduction circuit in an incandescent PAR lamp could be economical and provides improved performance. Unfortunately PAR lamps are commonly operated in close fixtures and therefore may be run hot, and circuits are known to fail early or not operate properly when run hot. There is then a need for a PAR lamp with a cool running line reduction voltage circuit.

FIELD OF THE INVENTION

The invention relates to electric lamps and particularly to electric lamps with reflectors. More particularly the invention is concerned with reflector lamps with integrated power supplies.

DESCRIPTION OF THE RELATED ART INCLUDING INFORMATION DISCLOSED UNDER 37 CFR 1.97 AND 1.98

BRIEF SUMMARY OF THE INVENTION

An incandescent lamp may be formed with a shell having an exterior side and an interior side defining a cavity, and at least one internal wall formed in the shell defining a through passage extending from the exterior side to the interior side. The shell may include a mechanical coupling formed on the exterior side. A light source is located in the cavity to face the interior side, and is electrically coupled to electric lamp leads that extend through the passage. A heat radiator assembly is positioned adjacent the exterior side with the radiator having a heat-dissipating surface or surfaces exposed to air. An integral power supply is enclosed in the heat radiator assembly and electrically connected to the light source through the electric lamp leads. A threaded base having exterior electrical contact points is electrically connected through base leads to the integral power supply. The shell, radiator assembly and base being mechanically are coupled as a unit.

DETAILED DESCRIPTION OF THE INVENTION

Figure 1:
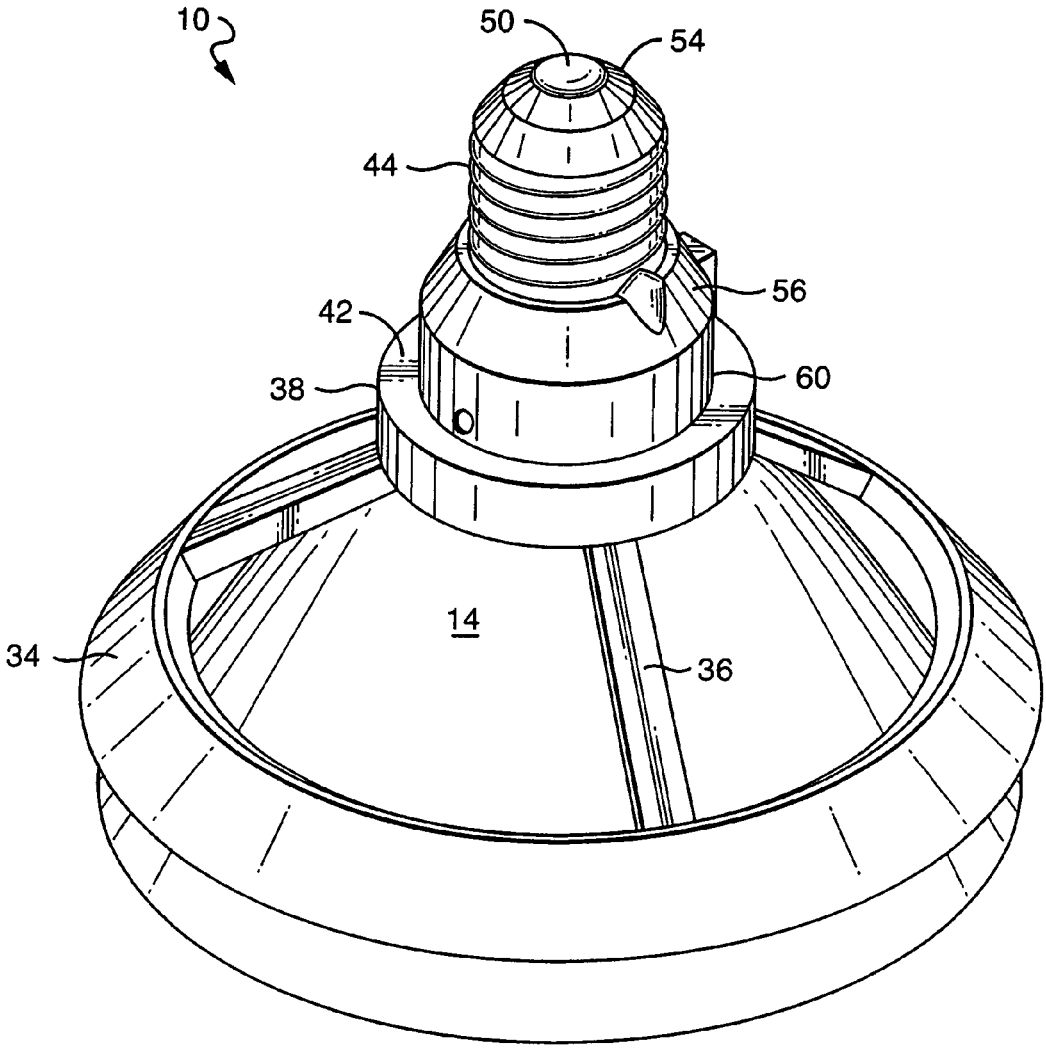
FIG. 1 shows rear perspective view of an incandescent lamp.
Figure 2:
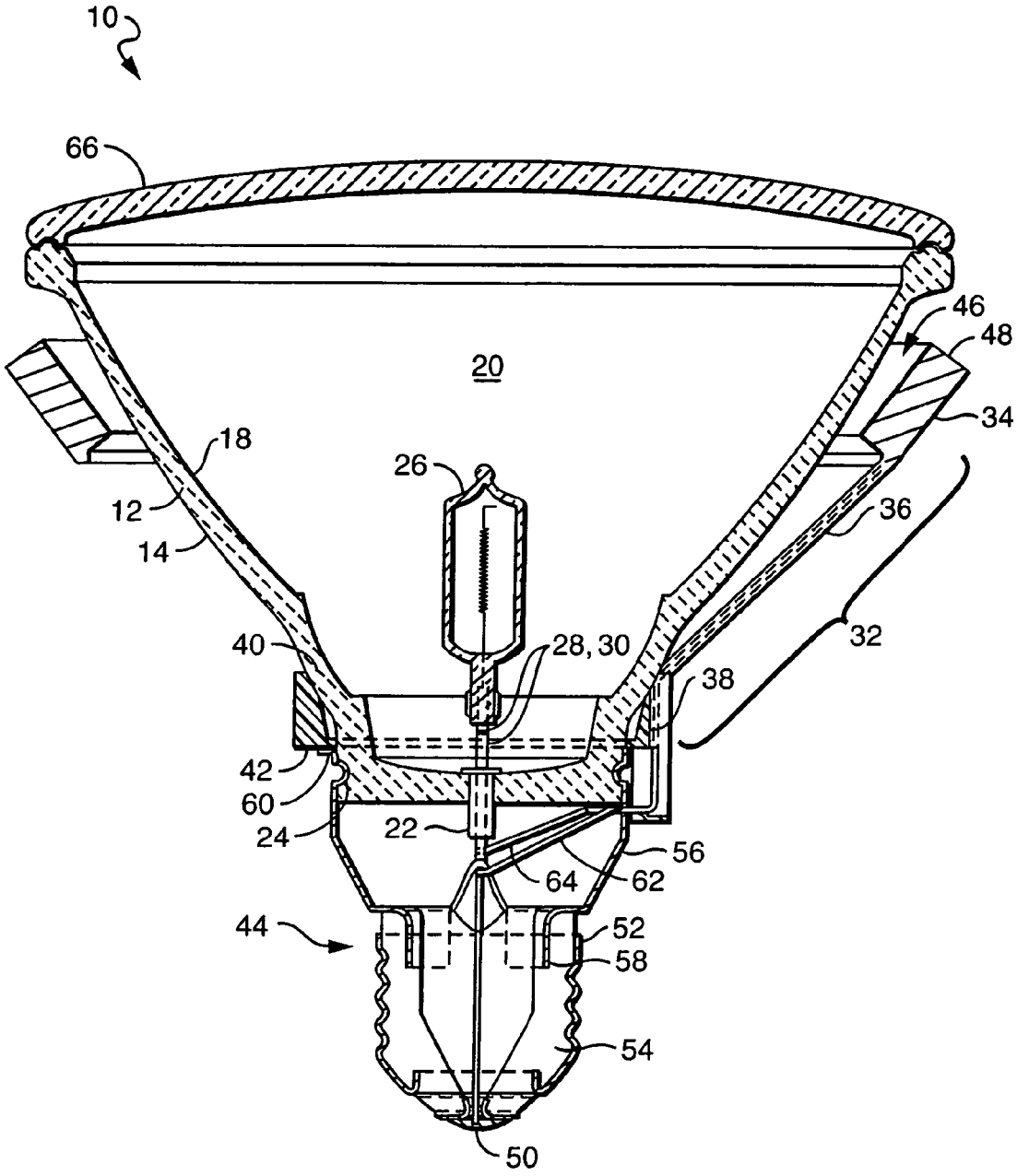
FIG. 2 shows cross sectional view of an incandescent lamp.
Figure 3:
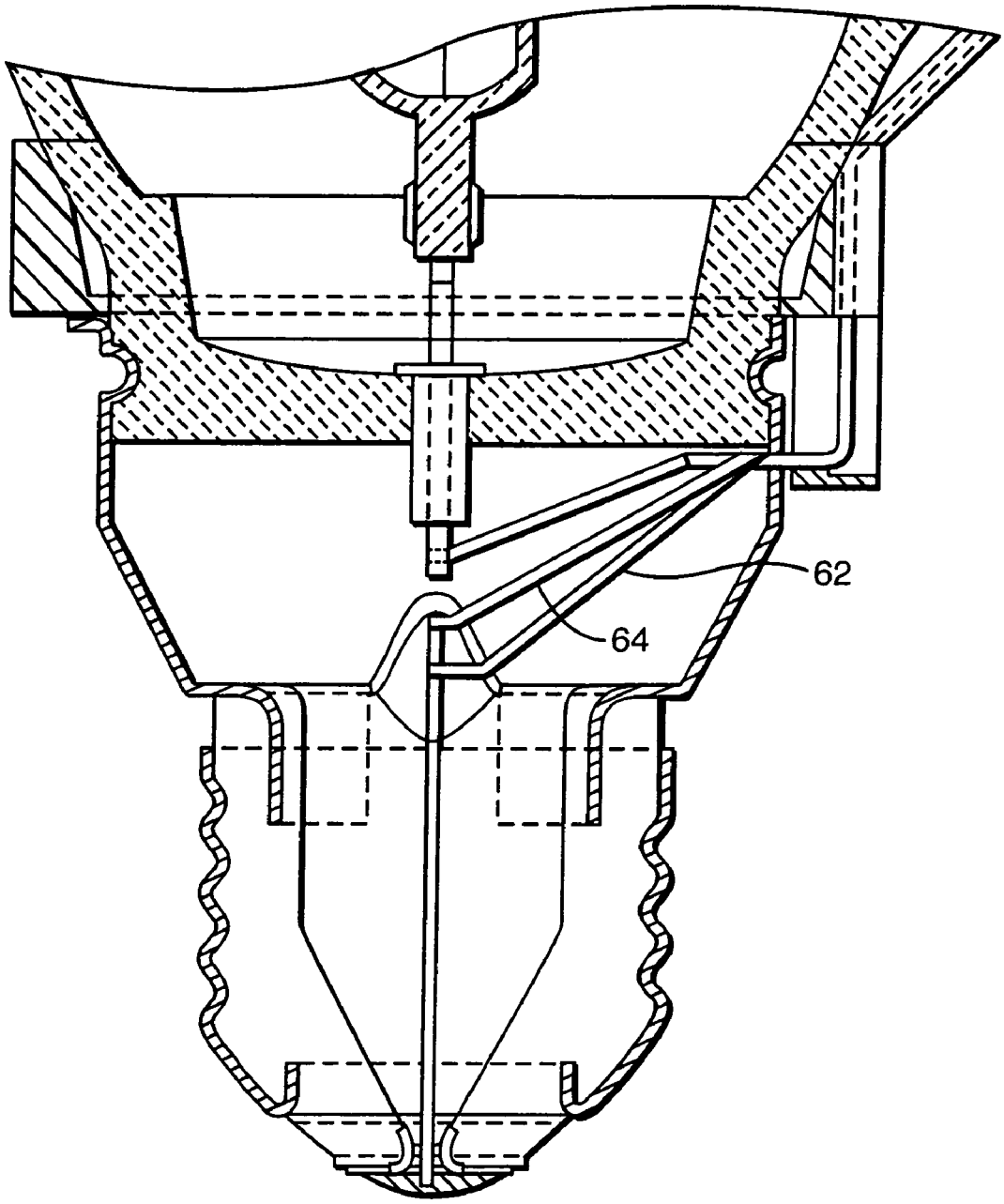
FIG. 3 shows cross sectional view of an incandescent lamp base.

FIG. 1 shows a rear perspective view of a preferred incandescent lamp 10, and FIG. 2 shows cross sectional view of the same incandescent lamp 10. Lamp 10 comprises a shell 12, a light source 26, radiator assembly 32, a power supply 48 (FIG. 2), a threaded base 44 and a cover lens 66. The preferred shell 12 is a molded glass body with an exterior side 14. The exterior side 14 is preferably conical in form. The shell 12 has an interior side 18 defining a cavity 20. Interior side 18 is preferably shaped and surfaced as is known in that art to project light with a desired beam pattern. The shell 12 has at least one internal wall that defines a through passage extending from the exterior side 14 to the interior side 18. The shell 12 also has a mechanical coupling 24 formed on the exterior side 14 to couple with the base 44. The mechanical coupling 24 may be a recess or protrusion that a walled portion of the base 44 may be peened into locking conformity with.

The preferred light source 26 is a tungsten halogen lamp capsule. The light source 26 is located in the cavity 20 facing the interior side 18 so that light may be projected in the desired beam pattern. The light source 26 is electrically coupled to a first electric lamp lead 28 and a second electric lamp lead 30. The lamp leads 28, 30 extend through the passage for electrical connection. In the preferred embodiment, for each lead 28, and 30 passes through a respective metal eyelet 22 fixed in a respective through passage, and the corresponding lead 28, 30 is soldered to the eyelet 22 thereby locking the lamp leads 28, 30 and the lamp capsule 26 in position.

The heat radiator assembly 32 is positioned adjacent shell 12 substantially along the exterior side 14. The preferred heat radiator assembly 32 has a form that is generally similar to the exterior side 14, so the two pieces may positioned parallel one another. In particular, the preferred exterior side 14 is conical in form and the preferred heat radiator assembly 32 generally has a conical form similar to the exterior side 14. The preferred radiator assembly 32 includes a ring 34 extending around the exterior side 14. The preferred ring 34 is supported by one or more arms 36 (preferably three arms) that extend from a mechanical attachment 38. The mechanical support includes a first side 40 that is shaped to form a close abutment with the exterior side 14, and a second side 42 that is shaped to contact the base 44. The mechanical support 38 may include a feature fitted to key the shell 12 to the mechanical support 38, and thereby rotationally lock the shell 12 with respect to the heat radiator assembly 32. The preferred ring 34 is offset from the exterior side 14 by an air passage 46, enabling airflow between the heat radiator assembly 32 and the exterior side 14. The air passage 46 enables airflow between the ring 34 and the exterior side 14, so that heat may be dissipated from a surface or surfaces of the heat radiator assembly 32 that are exposed to air. The heat radiator assembly 32 is preferably formed from a heat conductive material, for example a heat conductive plastic.

The integral power supply 48 is enclosed in the heat radiator assembly 32 and electrically connected to the light source 26 through the electric lamp leads 28, 30. The preferred integral power supply 48 is located in the preferred ring 34. The preferred integral power supply 48 converts line current and voltage to a low voltage power for supply to the light source 26 through leads 28, 30. A lower voltage can result in better incandescent or tungsten halogen lamp performance. There are a variety of known circuits for achieving the lower voltage and current goals suggested here. The particular circuit is a matter of design choice and is not substantially important to the lamp assembly and cooling structure described here. It is only relevant that the integral power supply 48 fit within the volume provided by the radiator assembly 32.

The threaded base 44 has a first exterior electrical contact point 50 and a second exterior electrical contact point 52 electrically separated by an electrical insulator 54. The preferred first contact point 50 is the axial contact typical of a threaded base. The preferred second contact point 52 is the threaded contact typical of a threaded base. The preferred electrical insulator 54 is a glass gob. The preferred base 44 includes a skirt 56 with a first edge 58 captured in the glass gob, while a second edge 58 of the skirt includes a rolled lip that extends radially away from the lamp axis. Alternatively the second edge 60 of the skirt may be formed with a flange, arms or similar features forming a face that may be pressed against the second side 42 of the mechanical support 38. The particular form of the second edge 60 is important only in that it should provide a stabile interface to press against the mechanical support 38. The two contact points 50, 52 are respectively electrically connected through base leads 62, 64 to the integral power supply 48. In the preferred embodiment the base leads 62, 64 are connected through the support arm 36 to the integral power supply 48 housed in ring 34 with the capsule 12 electrically couple in series with the integral power supply 48.

The exterior side 14 is mechanically positioned to abut the heat radiator assembly 32 along the first side 40 of the mechanical support 38. The abutment is structured to provide a stabile coupling between the reflector 12 and mechanical support 38 and may include a key and latch structure to resist rotation of the reflector 14 with respect to the mechanical support 38. The base 44 is positioned to abut the second side 42 of the mechanical support 38. For example, in the preferred embodiment rolled lip of the skirt 56 presses against the axial end of the heat radiator assembly 32. With the heat radiator assembly 32 tightly positioned between the shell 12 and the base 44, the shell 12 and base 44 are then coupled, for example by peening portions of the skirt 56 into or against recesses or protuberances formed on the reflector 14. The heat radiator assembly 32 is then retained between the shell 12 and the base 44 in a pinched fashion. The shell 12, radiator assembly 32 and base 44 form a single mechanical unit. A cover lens 66 may be attached to the reflector 12 by known methods, enclosing the capsule 26.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An incandescent lamp comprising:

a shell having an exterior side and an interior side defining a cavity, at least one internal wall formed in the shell defining a through passage extending from the exterior side to the interior side, and a mechanical coupling formed on the exterior side; the shell closed at a forward end by a lens;

a light source located in the cavity facing the interior side, and coupled to electric lamp leads extending through the passage;

a heat radiator assembly adjacent the exterior side, the radiator assembly having heat-dissipating surfaces exposed to air; wherein the heat radiator assembly includes a ring extending around the shell exterior, the ring positioned adjacent the lens, and the ring is supported by one or more arms extended from a mechanical attachment adjacent the through passage, the ring is offset from the exterior side by at least one passage, enabling airflow through the passage, between the ring and the exterior side, an integral power supply enclosed in the heat radiator assembly and electrically connected to the light source through the electric lamp leads;

a threaded base having exterior electrical contact points electrically connected through base leads to the integral power supply; and the shell, radiator assembly and base being mechanically coupled as a unit.

2. The lamp in claim 1, wherein the exterior side is substantially conical in form and the heat radiator assembly has a similar conical form.

3. The lamp in claim 2, wherein the conical heat radiator assembly is offset from the shell by at least one passage, enabling airflow between the conical heat radiator assembly and the exterior side of the shell.

4. The lamp in claim 1, wherein a first side of the heat radiator assembly abuts the exterior side, and the base is coupled to the shell and abuts a second side of the heat radiator assembly thereby pinching the heat radiator assembly between the shell and the base.

5. An incandescent lamp comprising:

a shell having an exterior side, the exterior side being substantially conical in form and including a key; and having an interior side defining a cavity; and at least one internal wall formed in the shell defining a through passage extending from the exterior side to the interior side; and a mechanical coupling formed on the exterior side; the shell closed at the forward end by a lens;

a light source located in the cavity facing the interior side; the light source being coupled to a first electric lamp lead and a second electric lamp lead, the lamp leads extending through the passage;

a heat radiator assembly adjacent the exterior side, the heat radiator assembly having a conical form similar to the exterior side; the radiator assembly includes a ring extending around the exterior side, the ring positioned adjacent the lens, the ring being supported by one or more arms extended from a mechanical attachment adjacent the through passage, the mechanical attachment including a feature fitted to the key thereby rotationally locking the heat radiator assembly with respect to the shell; the ring being offset from the exterior side by at least one air passage, enabling airflow between the conical heat radiator assembly and the exterior side, enabling airflow through the air passage, between the ring and the exterior side, the radiator assembly having heat-dissipating surfaces exposed to air;

an integral power supply enclosed in the heat radiator assembly and electrically connected to the light source through the electric lamp leads;

a threaded base having a first exterior electrical contact points and a second exterior electrical contact point, the contact points being electrically connected through base leads to the integral power supply; a first side of the heat radiator assembly abutting the exterior side, and the base being coupled to the shell and abutting a second side of the heat radiator assembly thereby pinching the heat radiator assembly between the shell and the base; and the shell, radiator assembly and base being mechanically coupled as a unit.

* * * * *